US008628127B2

(12) United States Patent
Prasad

(10) Patent No.: US 8,628,127 B2
(45) Date of Patent: Jan. 14, 2014

(54) VALUE ENGINEERED LATCH SYSTEM

(76) Inventor: Hari Prasad, Troy, MI (US)

( * ) Notice: Subject to any disclaimer, the term of this patent is extended or adjusted under 35 U.S.C. 154(b) by 374 days.

(21) Appl. No.: 12/937,712

(22) PCT Filed: Apr. 13, 2009

(86) PCT No.: PCT/US2009/002313

§ 371 (c)(1),
(2), (4) Date: Oct. 14, 2010

(87) PCT Pub. No.: WO2009/148484

PCT Pub. Date: Dec. 10, 2009

(65) Prior Publication Data

US 2011/0109104 A1 May 12, 2011

Related U.S. Application Data

(60) Provisional application No. 61/124,103, filed on Apr. 13, 2008.

(51) Int. Cl.
*E05C 3/16* (2006.01)

(52) U.S. Cl.
USPC ..... 292/220; 292/DIG. 42; 292/DIG. 14; 292/DIG. 61

(58) Field of Classification Search
USPC ..... 292/220, DIG. 42, DIG. 61, DIG. 14
See application file for complete search history.

(56) References Cited

U.S. PATENT DOCUMENTS

| | | | | | |
|---|---|---|---|---|---|
| 630,898 | A | * | 8/1899 | Kneisly | 296/76 |
| 1,769,151 | A | * | 7/1930 | Mason | 292/114 |
| 2,832,621 | A | * | 4/1958 | De Orlow | 292/52 |
| 2,834,626 | A | * | 5/1958 | Claud-Mantle | 292/52 |
| 3,743,045 | A | * | 7/1973 | Hansen | 180/69.24 |

* cited by examiner

*Primary Examiner* — Carlos Lugo
*Assistant Examiner* — Mark Williams

(57) ABSTRACT

A value engineered latch system for latching and unlatching closures in plurality of stages namely fully open, partially open and fully closed comprising: a spring comprising of a metal rod with plurality of wound segments, bent segments and free ends; a metal striker comprising of profiled edges and slots that interact with said spring; a self presenting secondary release system actuated by the movement of the said spring; a base plate that supports the said spring and the said self presenting secondary release system.

9 Claims, 11 Drawing Sheets

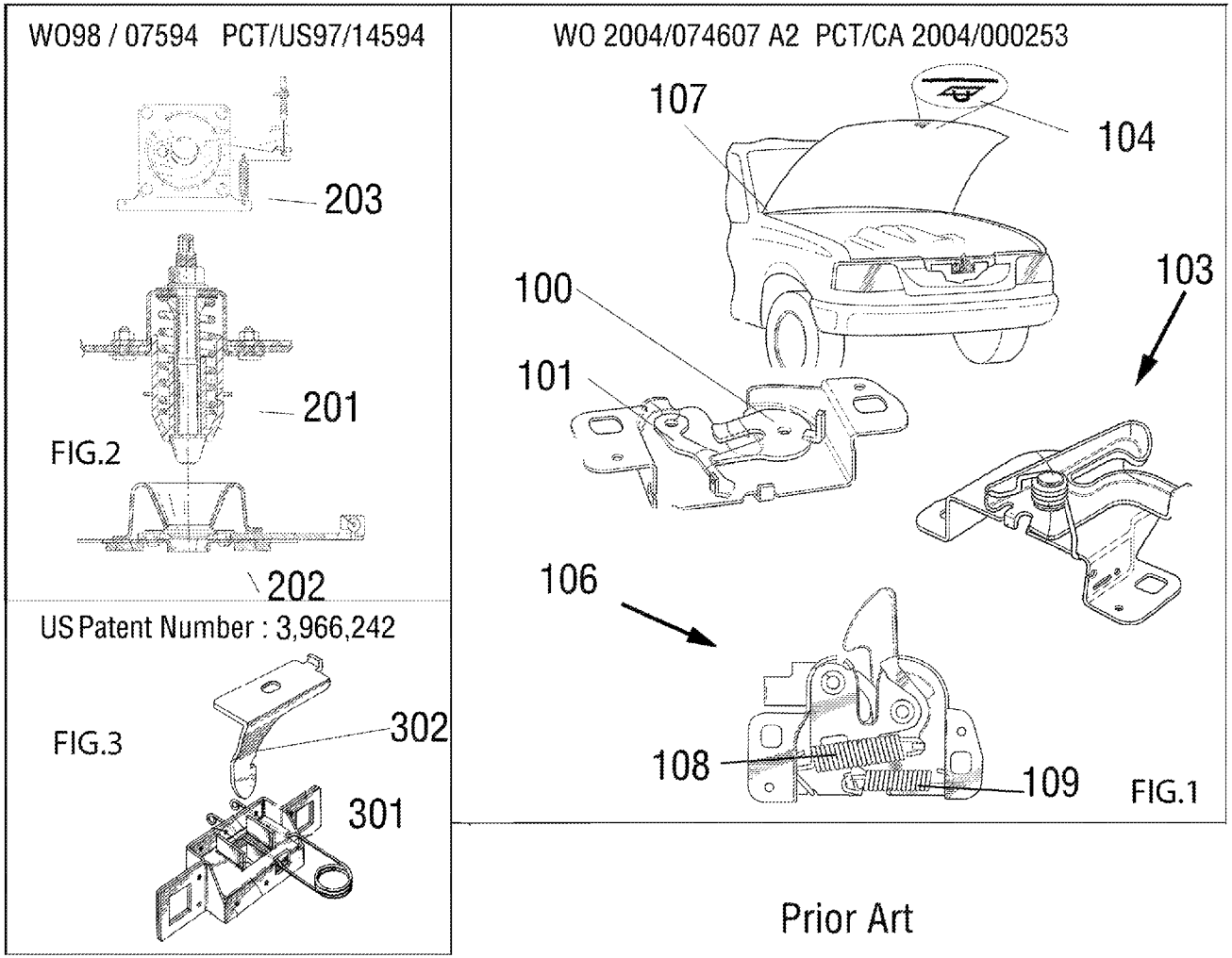
Prior Art

VALUE ENGINEERED LATCH SYSTEM

BACKGROUND

This invention uses the transmission of my provisional patent application 61124103 at the USPTO filed on Apr. 13, 2008.

BACKGROUND OF THE INVENTION

This invention relates to authmotive latch system for closures such as hood, doors, deck lids, etc.

DISCUSSION OF PRIOR ART

Today's automobile latch systems can be identified as, based on their basic principles of operation, ratchet, pawl, and striker rod type system and pin and catch system. These systems of latches pertaining to doors and hoods are capable of operating or required to operate in two stages. For example a hood latch operates in two stages where at the first stage the latch is released from the inside of the vehicle and at the second stage the latch is released from the outside. Generally there are two systems namely primary latch and secondary latch. These two systems may be completely independent of each other or they may share a few parts but still operate independently.

FIG. 1 shows a typical ratchet pawl system where a striker 104 is attached to an automobile hood 107. The ratchet 100 and pawl 101 are held in biased positions by ratchet spring 108 and the pawl spring 109. The picture also shows a secondary latch 103. The primary and the secondary latches are assembled together and installed over a cross member in front of the vehicle. The ratchet pawl system works on the basis that a striker rod gets trapped by a ratchet that is held in place by pawl. Both the ratchet and pawl are attached to springs. The spring attached to the ratchet, sometimes referred to as primary spring, provides the force required to lift the hood from its fully closed position. The ratchet pawl type primary latch has certain short comings. When the hood is being closed the striker rod first comes in contact with the ratchet and it has to overcome the high force exerted by the spring attached to the ratchet to actuate the ratchet to its final position. This excessive impact force exerted by the striker on the primary latch assembly makes the support system for the primary latch to be very robust. Such robustness can only be achieved by adding more components to the primary latch system. The hood inner that supports the striker needs to be reinforced with additional components. Yet another short coming of the ratchet pawl system is that the primary latch assembly, sometimes, is interfering with the hood inner and therefore a pocket has to be created in the hood inner. The pocket has to be reinforced with additional material. The other short coming of the ratchet pawl type that it requires the primary latch to be installed only a vertical surface. The vehicle components such as the radiator cross member needs to modified to create a vertical wall. If the modification is not feasible a new support structure is added to provide the support. In either case, making the support structure robust has cost and weight penalties. Yet another setback of the ratchet pawl system is the failure of the system when the ratchet becomes inoperable due to rusting or high friction due to surface quality deterioration of the sliding components. So the system needs lubrication and rust prevention. It has been established that the primary latch failure has been one of the major warranty recalls of many automakers in the past. A stuck pawl will prevent latching while a stuck ratchet will prevent opening. Yet another setback is that the striker rod and the ratchet have to align precisely for the proper operation. Misalignment at the assembly plant is one of the big problems in the automotive assembly lines. Special teams are deployed to fight misalignment in the primary latch system which adds cost. Yet another disadvantage of the ratchet pawl system is hood fluttering. Once the ratchet is locked in place by the pawl the striker rod can move within the ratchet. This causes the hood, which supports the striker, to flutter. Additional spring and components are added to overcome the hood fluttering. The main advantage of the ratchet pawl system that is aligned properly ensures positive engagement between the striker rod and ratchet provided the pawl is not stuck in open position. Yet another disadvantage when the primary and the secondary latches share components is that the combined system has to be very close to the edge of the hood so that the secondary system can be opened by manual operation. If the system cannot be packaged close to the front edge of the hood a self presenting secondary release lever has to be added to the system, which increases cost, weight and complexity. Yet another disadvantage of the ratchet, pawl and striker type latch relates to its ability to allow the hood to move down or displace during a collision with a pedestrian whose head impacts the hood's front zone.

A pin type primary latch is shown in FIG. 2. A pin encased in a shell is held down by a spring. When the pin assembly 201 descends into the receiving chamber 202 a sliding plate with a spring assembly 203 traps the pin. The pin is release from the sliding plate when it is pulled away from the pin with a cable. As far as the pin or bolt type primary latch is concerned it does not encounter the excessive force faced by the ratchet pawl type latch. But the main set back in this system is that it fails to engage if the parts start binding either due to lack of lubrication or surface deterioration of sliding members. The other setback is that the alignment between the bolt and the receiving unit has limited tolerance for variation. The bolt may break or damage the latch if there is misalignment. The other setback is that the primary and secondary systems cannot be combined as effectively as ratchet pawl type since there are no common parts between the two.

A type of latch that is close to the present invention is shown in FIG. 3. A spring 301 whose leg engages in to a slot in striker 302 retains it. But the feature of positive engagement is lacking.

OBJECTS AND ADVANTAGES

Accordingly, several objects and advantages of my invention are:

a. to reduce the number of components, especially the moving components in the primary and secondary latch system and self presenting secondary release arm;

b. to reduce the impact load that would normally be experienced by a comparable ratchet pawl latch system;

c. to minimize or eliminate the need for lubrication and increase life cycle durability of the primary and secondary latches;

d. to improve packaging capability when compared to the ratchet and pawl type primary latch that can only be mounted on a vertical wall;

e. to ensure positive latching when compared to the ratchet type and bolt type;

f. to improve assembly process;

g. to reduce the cost of the complete system;

h. to reduce the weight of the complete system to improve fuel efficiency;

i. to reduce the possibility of the hood opening due to latch failure during a collision;

j. to comply with collision requirement for pedestrian head impact requirements;

k. to have the ability to commonize the same system to fit into various vehicles by making slight adjustment to the latch system;

l. to eliminate fluttering of the hood;

BRIEF DESCRIPTION OF THE DRAWINGS

FIG. 1 is a perspective view of a ratchet pawl type latch system

FIG. 2 shows the components of a pin type latch.

FIG. 3 shows a striker spring type latch.

DETAILED DESCRIPTION OF THE PREFERRED EMBODIMENTS

Description of Figures

Figure 4:
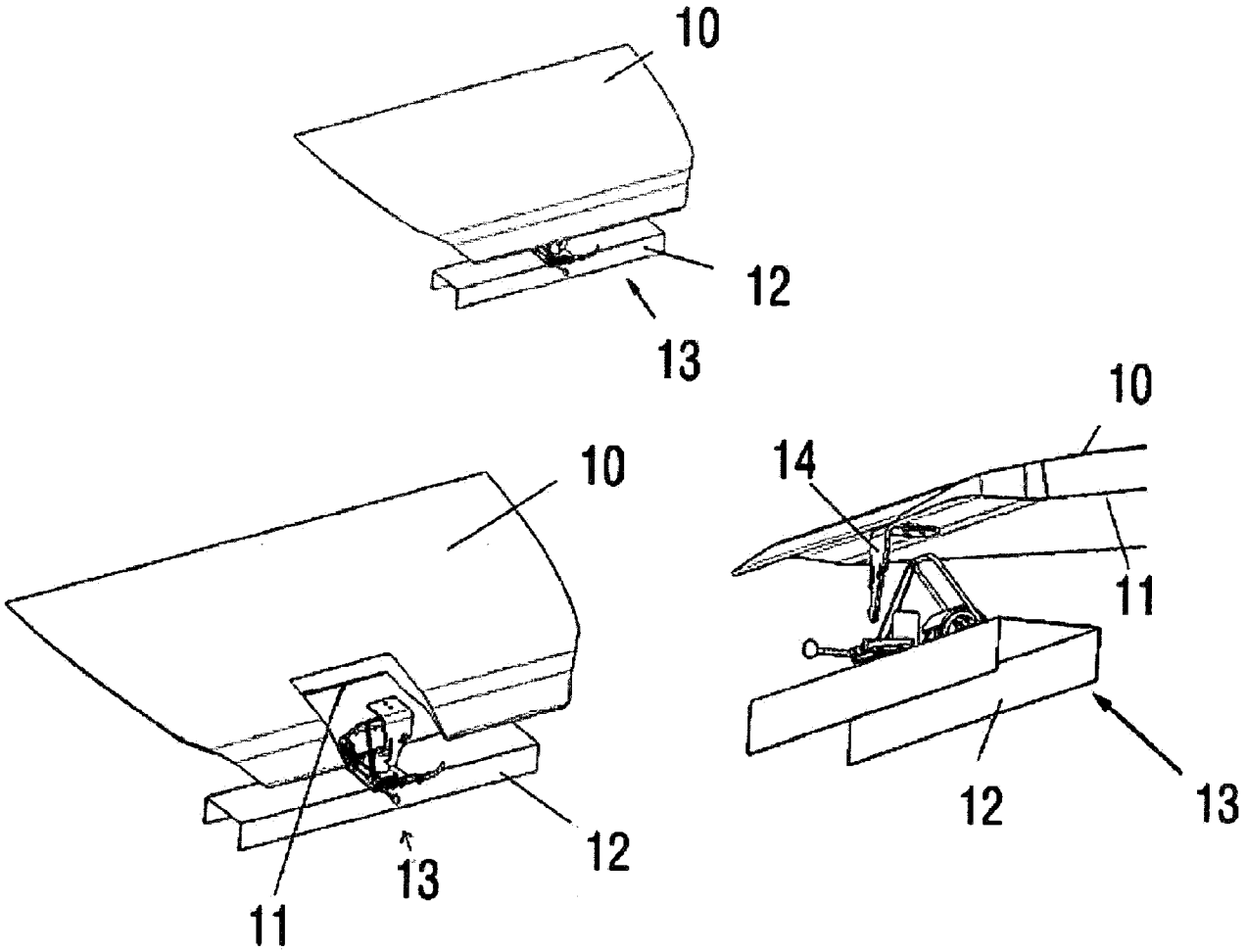
FIG. 4 shows multiple isometric views of value engineered latch system.

A typical embodiment of the present invention is illustrated in FIG. 4. Various perspective views of a hood 10 of an automobile, a hood inner 11 a latch support structure 12 such as a radiator cross member, a value engineered latch system 13 and striker 14.

Figure 5:
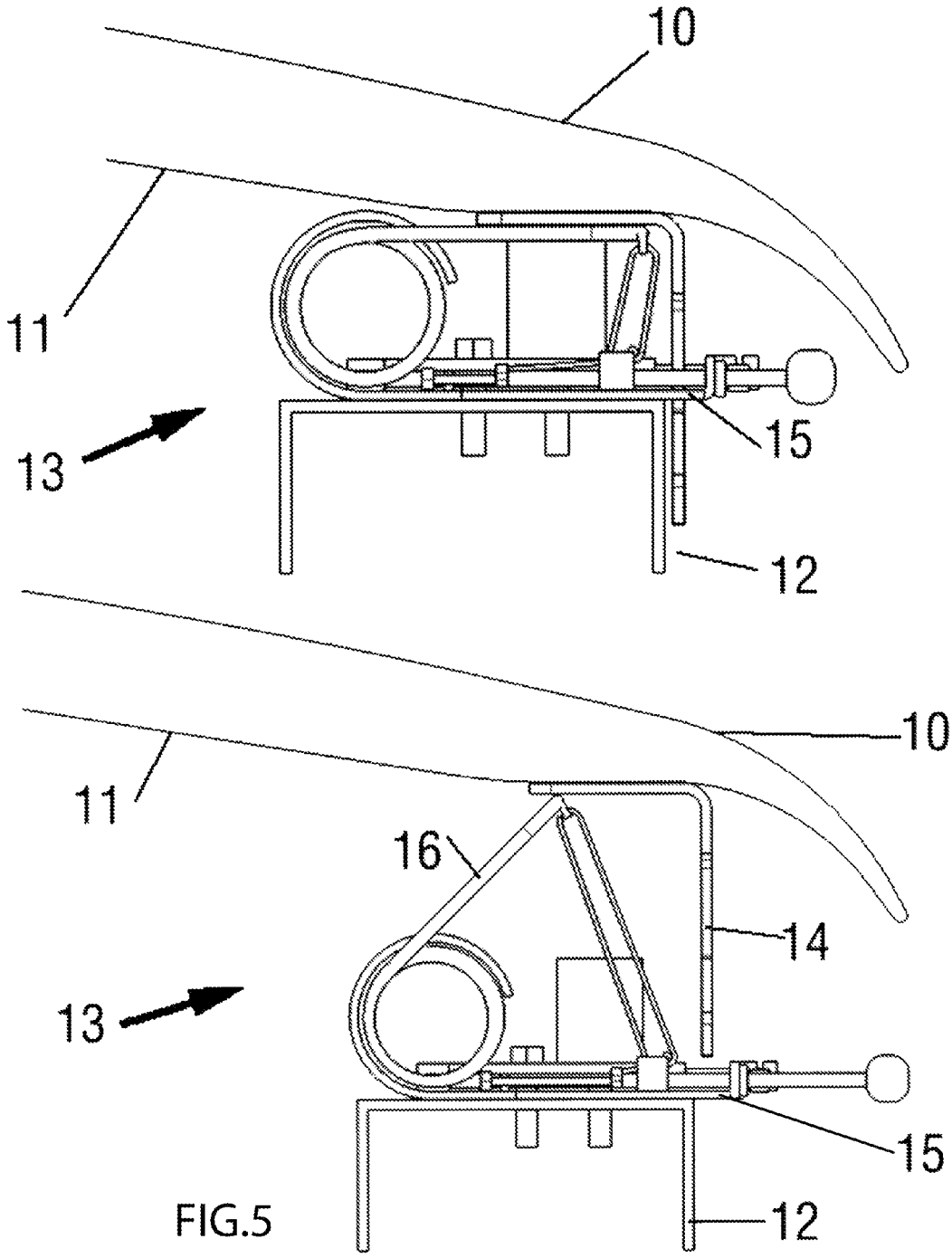
FIG. 5 shows open and closed view of the hood operated by the system.

FIG. 5 shows a hood inner 11 that is the inner part of the hood 10. The latch system comprises of a striker 14 that is rigidly attached to the hood inner 11 either by welding or by fasteners. The rest of the latch system 13 is attached to the latch support structure. The latch system comprises of a base plate 15 over which a spring 16 is located in such a manner that the parts of the spring is able to move about in a limited constrained environment.

Figure 6:
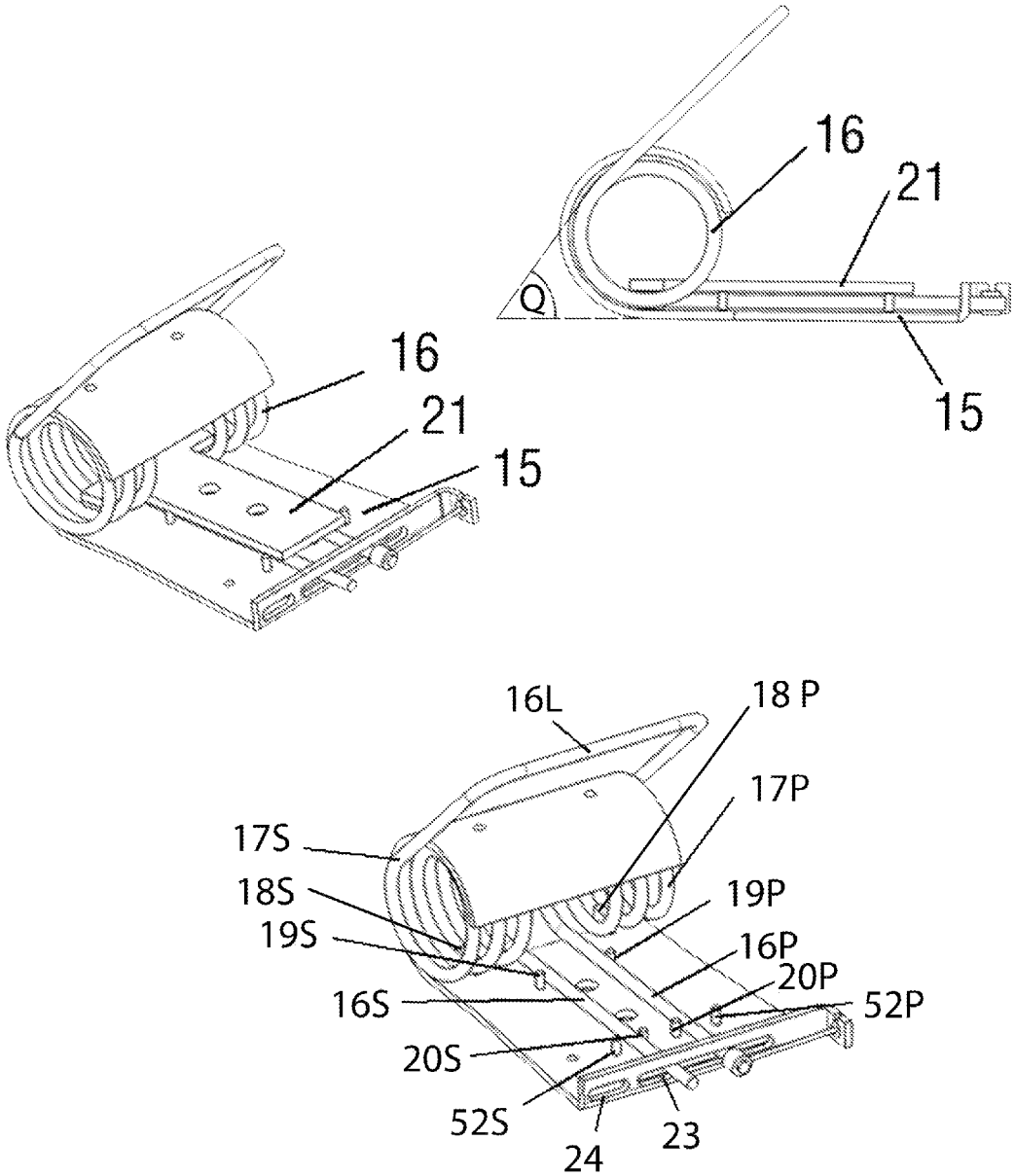
FIG. 6 shows various views of the latch system

FIG. 6 that shows the orientation of the spring 16 over the base plate 15. The base plate 15 is generally a flat plate with a curved end that encloses the spiral portion of the spring 16 and a sharply bent end with slots that allow the leg portion of the spring 16 to pass through. The movement of the spring 16 is restricted by a number of pins rigidly attached to the base namely primary pivot 19P, secondary pivot 19S, primary limit pin inner 20P, secondary limit pin inner 20S, primary limit pin outer 52P, secondary limit pin outer 52S, primary partition 18P, secondary partition 18S and top plate 21. The top plate 21 mounts over the pins and or partitions and is held rigidly in place by screws 28 and 29 passing through holes in the top plate 21 and base plate 15. The heights of the pins and partitions are the same and are slightly more than the thickness of the spring members passing between the top plate 21 and the base plate 15 thereby allowing the free movement of the spring 16. The primary partition 18P and the secondary partition 18S are tabs that are rigidly fixed into the base plate by welding or by other means to the base plate 15. The number of effective coils on the primary spiral 17P and secondary spiral 17S, zero and above that will affect the force exerted by the respective arms on the striker is decided by the location of the respective partitions. The forces are governed by the number of effective coils, the spring rate, the diameter of the coil, the spring wire diameter and the elasticity of the coil material. The number of effective coils zero and above is defined by the number of coils between the partitions and the respective arms. For a given number of effective coils the other factor that affects the forces is the elongation on the coil created between the partition and the pivots.

The primary pivot 19P, the secondary pivot 19S, the primary limit pin outer 52P and the secondary limit pin 52S are pins rigidly attached to the base plate 15 and the pins constrain the primary arm 16P and the secondary arm 16S respectively. The primary limit pin inner 20P and the secondary limit pin 20S are rigidly attached to the base plate and make contact to the primary arm 16P and secondary arm 16S respectively. The main objective of the pins and partitions is to keep the primary arm 16P and secondary arm 16S in a bias that keep the arms always move towards the center. Spring 16 works on the principle of tension and torsional forces of the spiral section of the spring 16. The torsional forces of the spiral section keeps lift arm 16L in an inclined angle Q as shown in FIG. 6. Decreasing the angle by the downward movement of the striker is opposed by the spiral segment of the spring 16 and lift arm 16L is forced to move upwards. More the deviation from the angle Q more will be the opposing force that will tend to bring the lift arm 16L to its neutral position that is angle Q. The torsional force is determined by the coil diameter, coil wire diameter and the elasticity of the material of the coil.

The primary arm 16P and the secondary arm 16S are biased towards the centerline, that is towards each other at the free ends. This is caused by the tension in the spiral section of the spring 16. The magnitude of the force exerted by the primary arm 16P and secondary arm 16S against the sliding surfaces of the striker 14 is determined by the location of the primary partition 18P, secondary partition 18S, primary pivot 19P and secondary pivot 19S. When the partitions are moved away from the center line and or the pivots move forward the forces increase. The forces exerted by the primary arm 16P and the secondary arm 16S hence can be different and can be customized as required.

A shock absorbing material such as a rubber bumper 30 is attached to the screw 28 either by molding the bumper to the screw head 28 or installed rigidly with an interference fit or attached or by threaded means so that bumper 30 can be raised or lowered to adjust the height to account for assembly variations or for the variation in force exerted by the striker 14.

Figure 7:
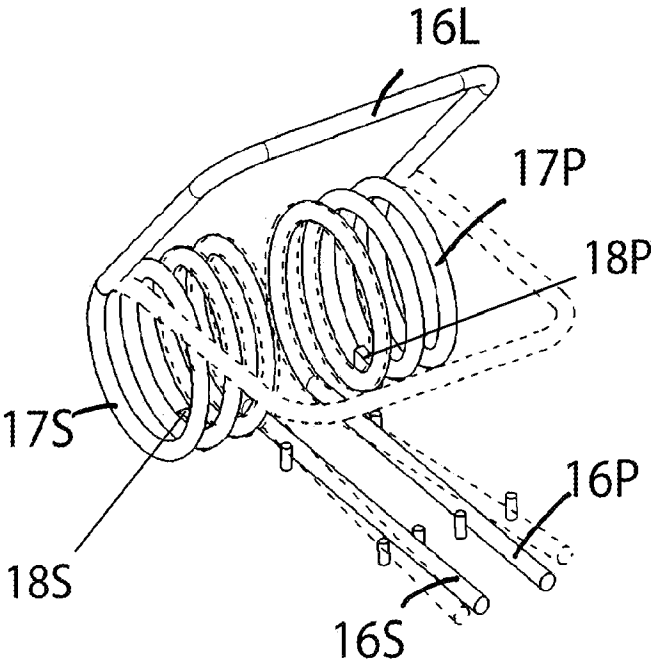
FIG. 7 shows the action of spring

At one end of the front plate 22 is located the primary release cable slot 25. A primary release cable outer 27 emerging from inside the vehicle is rigidly attached to the primary release cable slot 25. A primary release cable inner 26, which slides coaxially inside the primary release cable outer 27 extends through the primary cable release slot 25 attaches to the free end of primary arm 16P through a crimp. The primary release cable inner moves the primary arm 16P when actuated from inside the vehicle but also allows the primary arm 16P to move independently during operation. FIG. 7 shows the components of the spring 16. The spring 16 is essentially a double torsion spring comprising of a primary arm 16P, a secondary arm 16S, a primary spiral 17P, a secondary spiral 17S and a lift arm 16L. The extents to which the arms and spirals move are shown in phantom lines in FIG. 7.

Figure 8:
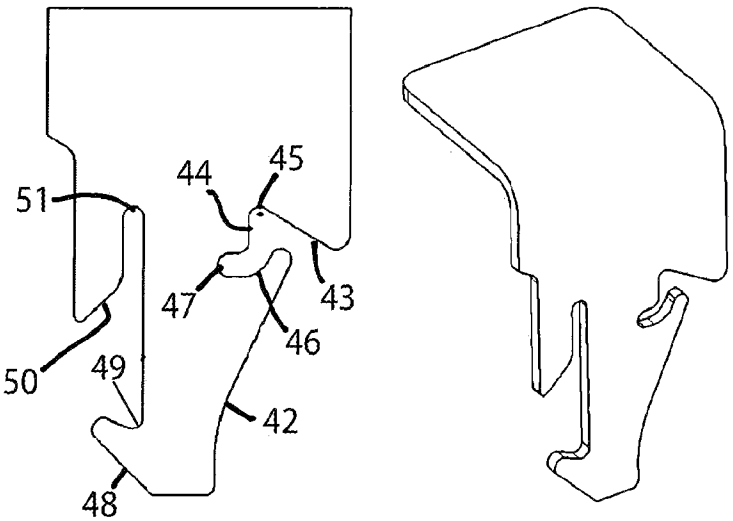
FIG. 8 shows perspective view of striker

The striker 14 is generally a plate that has unique profile at the lateral edges as shown in FIG. 8. The contours and profiles namely primary sliding surface 42, primary pull in ramp 43, primary strike surface 44, primary over slam slot 45, primary ramp 46, primary slot 47, secondary sliding surface 48, secondary ramp 49, secondary pull in ramp 50 and secondary upper spot 51 are named essentially on their function during the operation of the latch. The striker 14 rigidly attached to the hood inner 11 by fasteners or by spot welding traverses through the primary arm 16P and secondary arm 16S during operation. The primary arm 16P engages with the primary sliding surface 42, primary pull in ramp 43, primary strike surface 44, primary over slam slot 45, primary ramp 46, primary slot 47 while the secondary arm 16S engages with the secondary sliding surface 48, secondary ramp 49, secondary pull in ramp 50 and secondary upper spot 51.

Figure 9:
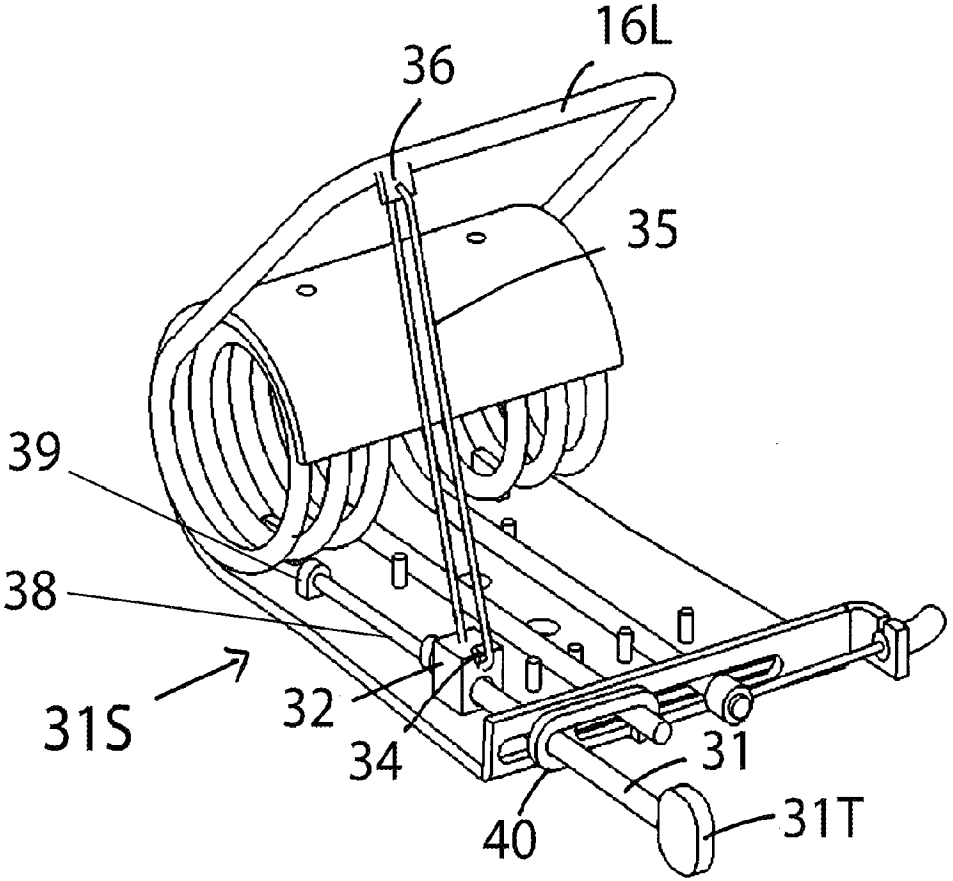
FIG. 9 is a perspective view of self presenting secondary release system

FIG. 9 shows the components of a self presenting secondary release arm system 31S. The function of the self presenting secondary release arm system 31S is to bring forward the self presenting arm from its retracted position when the hood 10 is released from its fully closed position and is ready to be opened from outside by releasing the secondary latch. The self presenting arm makes it easy for the operator to locate the secondary latch release mechanism without having to search for the same. The components of the self presenting secondary release arm as shown in FIG. 9 are self presenting arm 31, self presenting arm support 32, self presenting arm pulley 34, self presenting arm actuator chord 35, self presenting arm actuator chord guide 36, self presenting arm actuator chord clamp 37, self presenting arm retraction spring 38, self presenting arm retraction spring support 39 and secondary arm actuator link 40. One end of the self presenting arm actuator chord 35, made from a semi elastic material, is attached to the self presenting arm actuator chord guide 36, and is looped through the hole in the self presenting arm actuator chord guide 36 which is crimped or welded to the lift arm 16L. The chord is run through the self presenting arm pulley 34 that is mounted on the self presenting arm support 32. The chord passes through the support and then is crimped to the end of the self presenting arm 31. The self presenting arm 31 passes through the self presenting arm support 32 and front slot 24 moves in a reciprocating fashion when operated. The free end of the self presenting arm 31 is provided with a thumb 31T which when manually pushed activates the secondary arm 16S to release the secondary latch. The self presenting arm is constantly pulled backwards, towards the vehicle, by a self presenting arm retraction spring 38 one end of which is attached to the self presenting arm retraction spring support 39. The self presenting arm 31 is actuated back and forth by the raising and lowering of the lift arm 16L. The self presenting arm support block is pivotally attached to the base plate through self presenting arm support hole 33. The self presenting arm and the secondary arm 16S are connected through a secondary arm actuator link 40 which is rigidly attached to the self presenting arm and loops around the secondary arm 16S but allows it to move freely during the latch operation.

Operation—FIGS. 10, 11, 12, 13

The primary and secondary latch functionalities are accomplished by the interaction of the spring 16 and the striker 14. The striker 14 is attached to the hood inner and it moves up and down with the hood while the spring 16 is entrapped into the base plate 15 and top plate 21 and the base plate 15 attached to the top of the support structure such as radiator cross member. The interaction of the striker 14 and spring 16 is best explained in a sequence of figures that show the location of various components of the primary and secondary latch system. The figures, for simplicity sake, only shows the cross section of the arms and not the background information. When the hood 10 is being closed the striker 14 approaches the spring 14 between the primary arm 16P and secondary arm 16S.

Figures 10, 11, 12, 13:
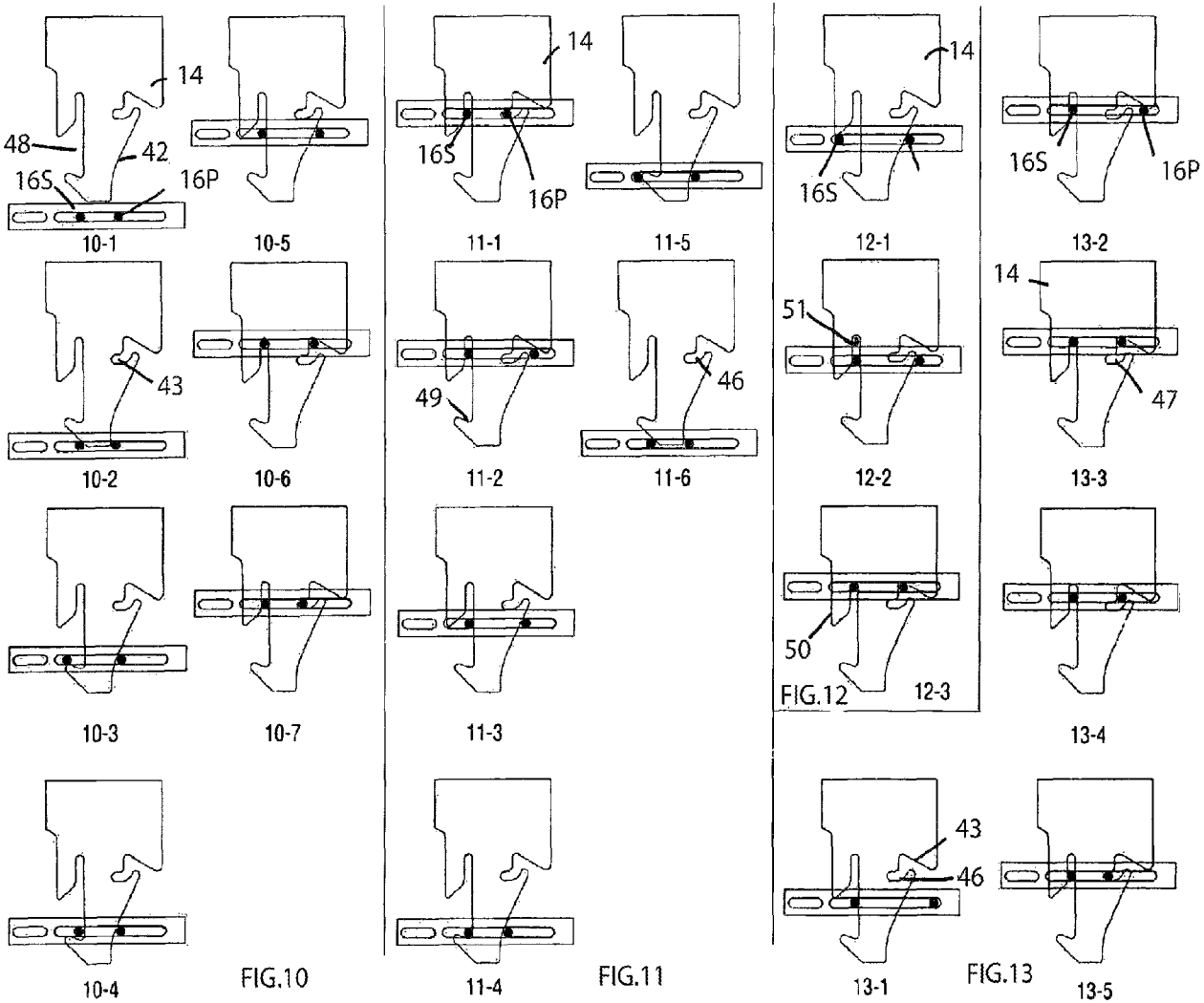
FIG. 10 shows the steps of closing operation
FIG. 11 shows the steps of opening operation
FIG. 12 shows the stages when secondary system is stuck
FIG. 13 shows the stages when primary system is stuck

Closing Operation:

It is easier to show the closing operation in stages. For a better understanding of the positions of various components FIG. 10 shows the incremental steps, in sequence, the closing operation. To clarity sake the numbers are provided only once per picture.

Stage 1 (FIG. 10-1)

The striker 14 is descending towards the primary arm 16P and the secondary arm 16S which are now resting against their respective pivot pins and limit pin inners (not shown).

Stage 2 (FIG. 10-2)

The primary arm 16P and secondary arm 16S are beginning to slide on primary sliding surface 42 and secondary sliding surface 48 respectively.

Stage 3 (FIG. 10-3)

The secondary arm 16S reaches the end of the secondary sliding surface 48.

Stage 4 (FIG. 10-4)

The secondary arm 16S engages over the secondary ramp

Stage 5 (FIG. 10-5)

The primary arm 16P slides over the primary sliding surface 42.

Stage 6 (FIG. 10-6)

The primary arm 16P strikes the primary strike surface 43 and the striker bottoms on the bumper 30 and over slammed.

Stage 7 (FIG. 10-7)

The primary arm 16P settles in the primary slot 47 after the striker gets lifted up by the lift arm 16L. The latch system 13 is now in closed position.

It is easier to show the opening operation in stages. For a better understanding of the positions of various components FIG. 11 shows the incremental steps, in sequence, the opening operation. To clarity sake the numbers are provided only once per picture.

Stage 1 (FIG. 11-1)

The striker 14 is in fully closed position. Now the primary arm 16P is pulled away from the primary slot 47 by the effort of the release cable inner 26 (not shown)

Stage 2 (FIG. 11-2)

The primary arm 16P comes completely out of the primary ramp 46 and the lift arm 16L starts lifting the striker 14 up.

Stage 3 (FIG. 11-3)

The striker continues to get raised by the lift arm 16L.

Stage 4 (FIG. 11-4)

The secondary arm 16S stops over the secondary ramp 49 preventing the striker from moving further.

Stage 5 (FIG. 11-5)

The secondary arm 16S is pulled away from the secondary ramp 49 and the lift arm 16L continues to lift the striker upwards.

Stage 6 (FIG. 11-6)

The striker 14 is completely released from the primary arm 16P and secondary arm 16S and is free to be lifted up.

Positive Latching of Primary Arm 16P

It is possible the primary arm 16P could remain stuck open i.e away from the striker 14. The primary limit pin outer 20P will prevent the primary arm 16P from moving outboard extensively. The following passages explain the positive latching feature of the invention. The primary pull in ramp 43 extends beyond the farthest point that the primary arm 16P can go. During the downward movement of the striker 14 the primary pull in ramp 43 pulls the stuck open primary arm 16P towards the striker. The movement of various components is shown below in stages for better understanding.

Again for the sake of convenience the movements of the striker 14 and the primary arm 16P and the secondary arm 16S are shown in stages in FIG. 13. For clarity sake the back ground information and the numbering of repeating components in the figure are omitted.

Stage 1 (FIG. 13-1)

The primary arm 16P is stuck in open position that is away from the striker 14. It is necessary to draw the primary arm 16P inboard so that the latch will be engaged.

Stage 2 (FIG. 13-2)

The striker 14 continues to come down and the primary pull in ramp 43 encounters the primary arm 16P and the angle of the primary pull in ramp 43 starts to pull the primary arm 16P inboard.

Stage 3 (FIG. 13-3)

The striker 14 or hood bottoms out over the bumper 40 (not shown) and comes to a stop.

Stage 4 (FIG. 13-4)

The downward pressure on the striker is released and the lift arm 16L begins to lift the striker 14 and the primary arm 16P comes in contact with the primary ramp 46.

Stage 5 (FIG. 13-5)

Further upward movement of the striker 14 pushes the primary arm 16P completely into the primary slot 47. The latch system 13 is now closed.

Positive Latching of Secondary Arm 16S

The secondary arm 16S operates between top plate 21 and the base plate 15. It is possible the secondary arm 16S could remain stuck open that is away from the striker 14. The secondary limit pin outer 20S will prevent the secondary arm 16S from moving outboard excessively. The following passages explain the positive latching feature of the invention. The secondary pull in ramp 50 extends beyond the farthest point that the secondary arm 16S can go away from the striker. During the downward movement of the striker 14 the secondary pull in ramp 50 pulls the stuck open secondary arm 16S towards the striker. The movement of various components is shown below in stages for better understanding.

The following passages explain the positive latching feature of the invention. Again for the sake of convenience the movements of the striker 14 and the primary arm 16P and the secondary arm 16S are shown in stages in FIG. 12.

Stage 1 (FIG. 12-1)

The secondary arm 16S is stuck in open position that is away from the striker 14. It is necessary to draw the secondary arm 16S inwards so that the latch will be engaged.

Stage 2 (FIG. 12-2)

The striker 14 continues to come down and the secondary pull in ramp 50 encounters the secondary arm 16S and the angle of the secondary pull in ramp 50 starts to pull the secondary arm 16S inwards.

Stage 3 (FIG. 12-3)

The striker 14 bottoms out over the bumper 40 (not shown) and comes to a stop. The secondary arm 16S is completely pulled into the secondary upper spot 51.

Figure 14:
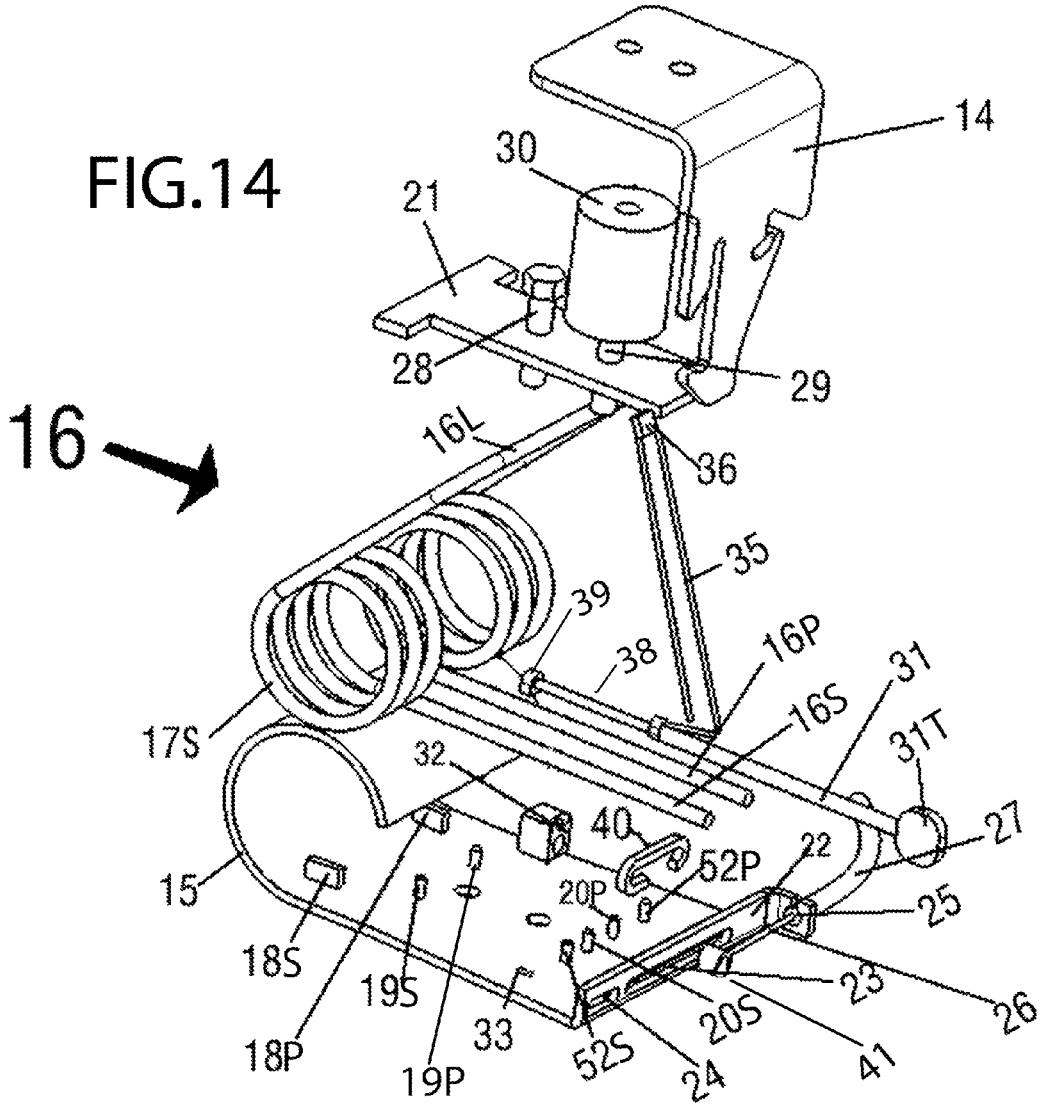
FIG. 14 shows view of complete assembly

FIG. 14 shows an exploded view of the value engineered latch system 13 with the components of the system labeled.

Figure 15:
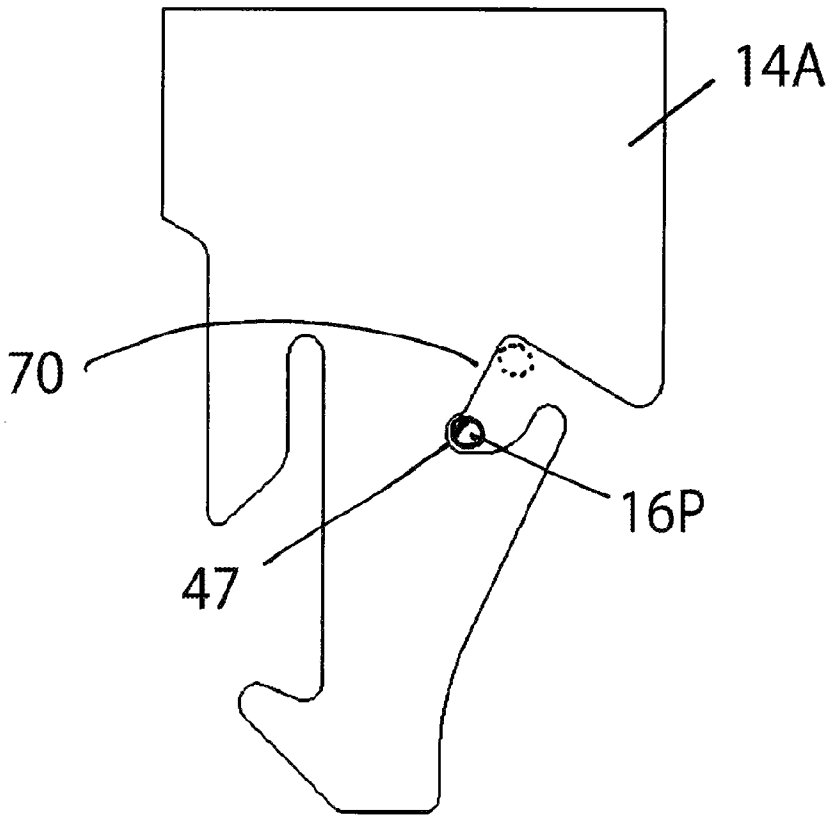
FIG. 15 shows front view of safety striker

FIG. 15 shows a safety striker 14A that is similar to the striker 14 in all aspects except for the change shown in a safety ramp 70. The primary arm 16P is located in primary slot 47. If an external object, such as a human head or body, comes in contact with the hood 10 at a high speed the hood needs to move towards closing direction to reduce the impact. The safety ramp 70, will allow the safety striker 14A to move down to the over slam position thus reducing the severity of the impact to the human.

Figure 16:
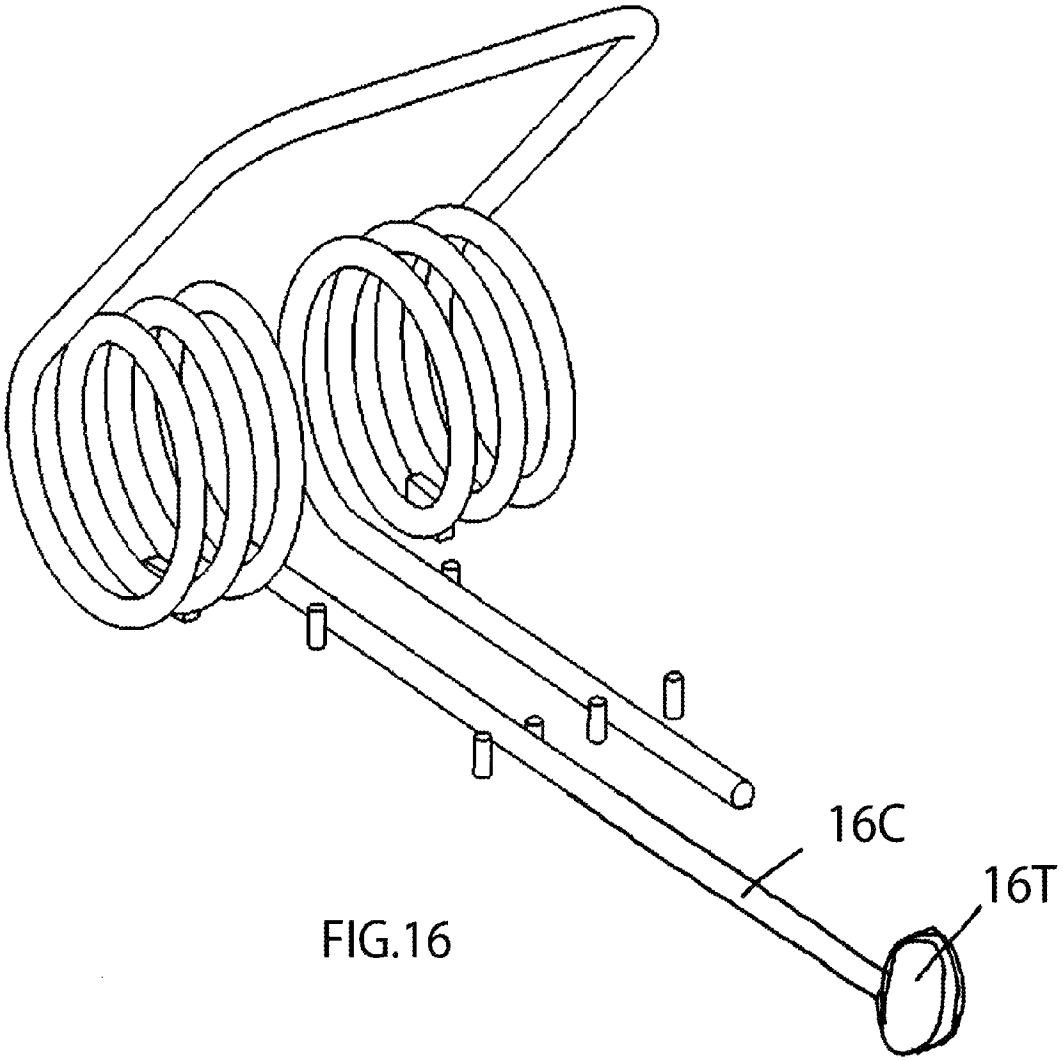
FIG. 16 shows iso view of spring

FIG. 16 shows an alternative of the secondary arm 16C that has a thumb 16T so that there is no need for the self presenting secondary release arm. When the secondary latch needs to be released the thumb 16T is directly pushed outboard thus releasing the secondary arm 16*c* from restraining the striker 14 or 14A.

Figure 17:
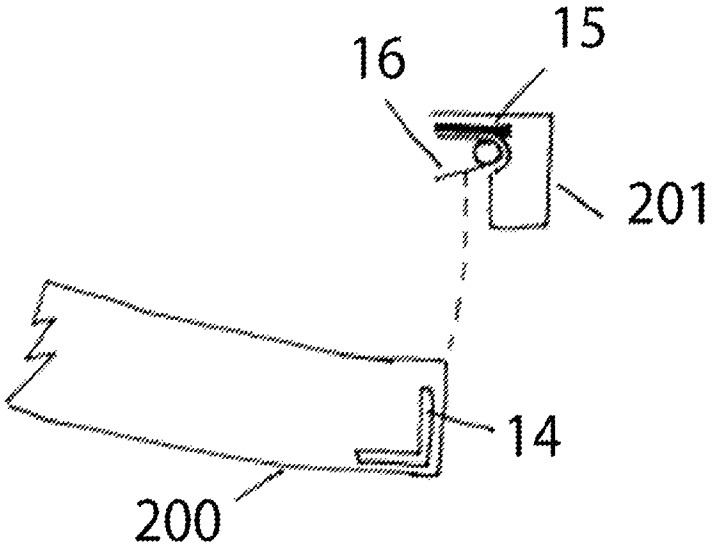
FIG. 17 shows the top view of a typical door and proximate where the striker is attached to the door outer and the spring assembly is attached to the proximate.

FIG. 17 shows the latch system adapted to an automobile door where the striker plate is fastened or welded to the door outer 200 while the base plate and spring assembly is attached to the proximate body structure including B pillar or C pillar 201. The interaction between the striker plate 14 and the spring 16 are very similar to the narrative above. There are difference in the modes in which the primary arm 16P and secondary arm 16S are operated and will depend on vehicles body structure and mode of actuation such as electrical and or mechanical actuation through complex linkages. It is only possible to show a schematic representation of how the components of the latch system would interact.

Figure 18:
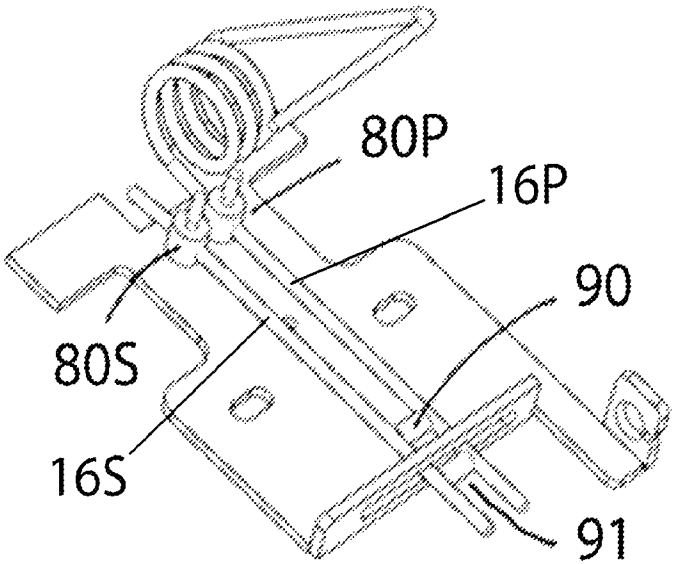
FIG. 18 shows the primary pass through pivot pin and secondary pass through pivots pin supporting their respective arms and augmenting springs connecting primary and secondary arms

FIG. 18 shows the primary arm 16P and secondary arm 16S pass through a primary pass through pivot 80P and a secondary pass through pivot 80S respectively. The pins are pivotally or rigidly attached to the base plate. The arms are secured rigidly to the pins by means of screws or weld. This provides for the primary arm or secondary arm to be completely independent of the respective spirals where by the primary arm 16P and secondary arm 16S can function in a standalone manner.

FIG. 18 also shows augmenting springs 90 and 91 connecting the primary arm 16P and the secondary arm 16S. Augmenting springs 90 and 91 bias the primary arm and the secondary arm towards the striker and enhance the force applied by the primary arm 16P and secondary arm 16S on the striker. This arrangement allows for further customization of the forces in the latch system. The augmenting springs 90 and 91 attach to the primary arm 16P and the secondary arm 16S by any means including wind or hook around the primary and secondary arm 16S. The forces on the primary arm 16P and secondary arm 16S are influenced by the spring rate of augmenting springs 90 and 91.

What is claimed is:

1. A value engineered latch system for an automobile door or hood, the latch system having a primary latch and a secondary latch, the latch system being adapted to positively hold or latch the door or hood in a fully closed position and a partially open position when operated by a primary release, and the latch system being adapted to allow the door or hood to be fully open when operated by a secondary release, the latch system comprising:

a base plate adapted to be attached to a member of the automobile proximate the door or hood the base plate being coupled to a spring having two helical windings, both helical windings having a longitudinal axis extending therethrough; wherein, of the two helical windings, a first helical winding is wound with a primary spiral and a second helical winding is wound with a secondary spiral, where ends of the first and second helical windings are located near each other and extend out from between the two helical windings of the spring at an angle of about ninety degrees to the longitudinal axis of the two helical windings to form a primary arm and a secondary arm, and the other ends of the two helical windings are coupled together to form a lift arm;

a striker adapted to be attached to the door or hood, the striker having a primary slot on one edge of the striker, the primary slot adapted to engage the primary arm to hold the door or hood fully closed, and a secondary ramp on another edge of the striker opposing the one edge of the striker, the secondary ramp adapted to engage the secondary arm to hold the hood or door partially open; and a self presenting secondary release system attached to the base plate, the secondary release system having a secondary release arm to present itself for easy manual access and to operate the secondary arm.

2. A value engineered latch system of claim 1, wherein the self presenting secondary release system comprising:

a self presenting arm that actuates the secondary arm through an actuator link and reciprocates through a self presenting arm block pivotally attached to the base plate;

an elastic self presenting arm chord that links a segment of the said spring to one end of the self presenting arm moves the self presenting arm forward when the hood is opened; and a retracting spring connects the self presenting arm and the base plate and keeps the self presenting arm biased to retract.

3. A value engineered latch system of claim 1, wherein a top plate is coupled with the base plate encompassing portions of the primary arm, the secondary arm, primary winding and secondary winding and allowing them to move within the space between the plate and the base plate.

4. A value engineered latch system of claim 1, wherein the edges of striker plate with plurality of profiles comprising:

a primary pull in ramp to pull a stuck open primary arm during closing as a means for positive primary latching;

a primary over slam slot to allow over travel of the striker plate past its closed position without interfering with the primary arm thereby eliminating the severity of closing impact on the latching system;

a primary slot to lock in the primary arm and striker plate in the closed position;

a primary ramp to guide the primary arm into the primary slot and to add resistance for the primary arm to be pulled away from the striker plate;

a secondary pull in ramp to pull a stuck open secondary arm;

a secondary upper slot to allow the striker to move past the fully closed position without interfering with the secondary arm there by eliminating the severity of the closing impact on the latching system;

a secondary ramp to engage the secondary arm and the striker plate in partially open position and to resist the movement of the secondary arm away from the striker plate;

a safety ramp to allow the striker to move towards the closing direction allowing the hood to absorb the energy of impact of a human there by reducing the severity of impact to the human during an accident; and a bumper made from elastic material that is adjustably attached to the base plate.

5. A value engineered latch system of claim 1, wherein means are provided to limit the travel of the lift arm.

6. A value engineered latch system of claim 1, wherein a top plate is coupled with the base plate encompassing portions of the primary arm, the secondary arm, primary winding and secondary winding allowing them to move within the space between the plate and the base plate.

7. A value engineered latch system of claim 1, wherein the base plate comprising:

a primary partition that allocates the number of primary windings ranging zero and above, that are subjected to tension during the movement of the primary arm;

a secondary partition that allocates the number of secondary windings ranging zero and above that are subjected to tension during the movement of secondary arm;

a slotted member that restricts the movement of the primary arm and the secondary arm away and towards the base plate; and plurality of limiting features and partitions that restrict the movement of the primary arm, the secondary arm, tensional portion of the primary spiral, torsional portion of the primary spiral, tensional portion of the secondary spiral and torsional portion of the secondary spiral.

8. A value engineered latch system of claim 1, wherein the base plate comprising:

a primary pass through pivot pin is pivotally or rigidly attached to allow the primary arm to operate independently without being connected to the primary winding; and a secondary pass through pivot pin is pivotally or rigidly attached to the base plate to allow the secondary arm to operate independently without being connected to the secondary winding.

9. A value engineered latch system of claim 1, wherein the primary arm and secondary arm are coupled with one or more augmenting springs to allow customization of the latch system.

* * * * *